US008420880B2

(12) United States Patent
Tsia et al.

(10) Patent No.: US 8,420,880 B2
(45) Date of Patent: Apr. 16, 2013

(54) REMOVAL EQUIPMENT AND METHOD FOR THE STORAGE FACILITY FOR TRANSURANIUM COMPOUNDS

(75) Inventors: Cheng-To Tsia, Taoyuan County (TW); Kuo-Long Liang, Taoyuan County (TW); Jiang-Tzuan Wu, Taoyuan County (TW); Chung-Shin Lee, Taoyuan County (TW)

(73) Assignee: Institute of Nuclear Energy Research, Jiaan Village, Longtan, Taoyuan (TW)

( * ) Notice: Subject to any disclaimer, the term of this patent is extended or adjusted under 35 U.S.C. 154(b) by 1512 days.

(21) Appl. No.: 12/238,453

(22) Filed: Sep. 26, 2008

(65) Prior Publication Data

US 2013/0072741 A1 Mar. 21, 2013

(51) Int. Cl.
*B08B 17/00* (2006.01)

(52) U.S. Cl.
USPC ..... 588/6; 422/184.1

(58) Field of Classification Search ..... 588/1, 6, 588/259, 900, 901; 422/184.1
See application file for complete search history.

(56) References Cited

U.S. PATENT DOCUMENTS 4,293,438 A * 10/1981 Ledebrink et al. ..... 588/6
5,405,509 A * 4/1995 Lomasney et al. ..... 205/688

* cited by examiner

*Primary Examiner* — Edward Johnson

(57) ABSTRACT

A nuclear chemistry laboratory adopts In-site Cutting Technique to remove the large-scale glove box contaminated by transuranium compounds. During removal operation, to prevent further spreading of contamination, it is necessary to build an alpha airtight quarantine tent around the glove box that is ready to be cut. Each section of the quarantine tent maintains a stable airflow and sufficient air exchange to meet negative pressure requirements and effectively prevent leak of α contamination. It is necessary to install a negative pressure ventilation system to assure the operation of the quarantine tent that has a pressure gradient and allows airflow from low contamination area to high contamination area to effectively prevent spreading of α contamination and also increase the safety for the transuranium contaminated glove box that is not in service.

9 Claims, 1 Drawing Sheet

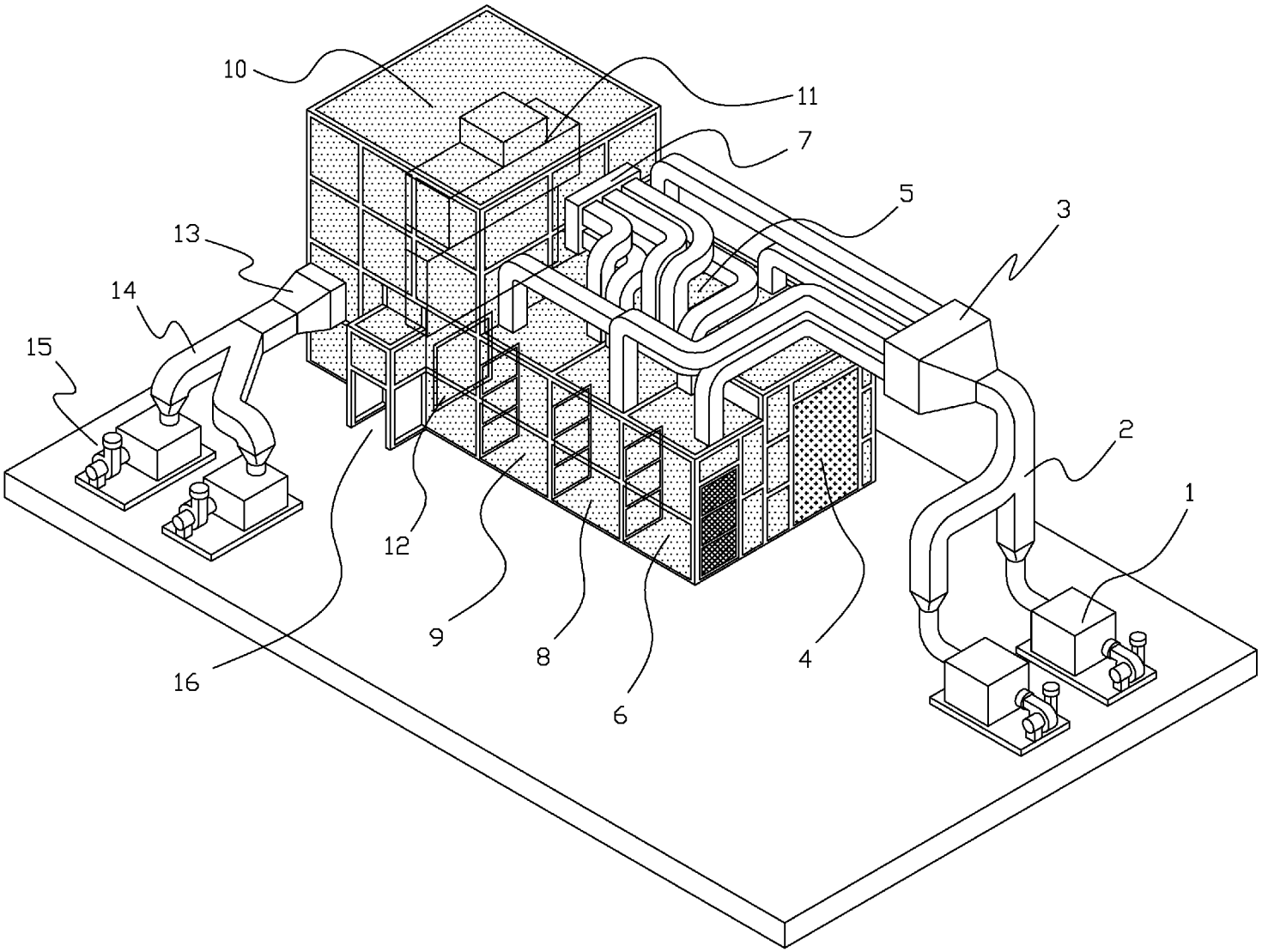
1
2
3
4
5
6
7
8
9
10
11
12
13
14
15
16

REMOVAL EQUIPMENT AND METHOD FOR THE STORAGE FACILITY FOR TRANSURANIUM COMPOUNDS

BACKGROUND OF THE INVENTION

1. Field of the Invention

The invention relates to a disposal program for large-scale storage facility for transuranium compounds, especially a removal process for a large-scale glove box contaminated by transuranium compounds. It is to establish the quarantine tent and the negative pressure ventilation system in a removal process for a large-scale glove box contaminated by transuranium compounds to attain the α contamination quarantine effect and the radiation safety and prevention requirements.

2. Description of the Prior Art

The integrated removal technology for medium-scale and small-scale glove boxes of α contamination involves cutting and sealing of the peripheral piping for the glove boxes. The glove box is put into a large PVC bag. Then the bag is sealed and wrapped by a large tape to prevent the leak of α contamination from the glove box and minimize the generation of unnecessary secondary wastes concerning "radiation safety and prevention".

SUMMARY OF THE INVENTION

The two large glove boxes, Unit 20 and Unit 21, for transuranium compounds in the nuclear chemistry laboratory for Institute of Nuclear Energy Research are heavily contaminated equipment by transuranium compounds. The interior surfaces, framework and components for the glove boxes have been subject to α contamination, especially Pu-239 and Pu-240 contamination. The Unit 21 glove box dimensions are 305 cm wide, 202 cm deep and 478 cm high. Three surfaces (front, left and top) of the glove box are constituted by large 10 mm thick acrylic sheets (Perspex) and stainless steel (304L) frames. Another three surfaces (back, right and bottom) of the glove box are constituted by welded 3 mm thick 304 L stainless steel sheets. They are tightly attached to the wall and the ground. The entire glove box is situated on a 25 cm high cement base. In the glove box there is a large liquid waste sedimentation tank that is designated to collect all liquid wastes of transuranium compounds. It also uses calcium carbonate coprecipitation method to reduce the plutonium content in the liquid waste to below 10 μg/l. Then the treated liquid waste is transported to the liquid waste treatment plant of Chemical Technology Unit for further treatment. Due to the large size and interior structure, the glove box cannot be moved out at one time. The other glove box, Unit 20, is L-shape and composed by a large glove box and a small glove box. The dimensions for the bottom box are 350 cm wide, 170 cm deep and 130 cm high. A small glove box that has dimensions of 70 cm wide, 150 cm deep and 180 cm high stands up on the left side of the bottom box. There are also few small pipes entering the bottom box. The entire glove box is situated on a 15 cm high cement base. In the glove box there are six medium and large pumps and many stainless steel pipes ($\phi \leqq 2.5$) of different diameters that are designated to transport liquid wastes between the liquid waste holding tank and the sedimentation tank for Unit 21 glove box. The equipments and piping in the two glove boxes and the interior surface of the glove boxes are all contaminated by transuranium isotopes. Their α contamination values are $1.5\times10^6$~$4.1\times10^7$ Bq/100 $cm^2$(Unit 21) and $4.1\times10^6$~$8.5\times10^7$ Bq/100 $cm^2$(Unit 20) respectively. The values are measurement results obtained by Smear Test.

The objective of the invention is to facilitate "in-site cutting technique". A quarantine tent is built around the glove box by using 50×50×3.2$^t$ mm zinc-plated square pipes as frames and 9.5$^t$ mm thick clear PC (polycarbonate) sheets as surface panels and tightly attached to inner sides of the frames. The seams between panels are sealed by silicones to achieve airtightness. Unit 21 glove box is used as an example for the removal process. G32 room is separated from the glove box by installing a quarantine tent. The quarantine tent has six sections, including a "removal operation section" and five "air-lock rooms". The "removal operation section" is also briefly called C1 (dimensions: 400 L×420 W×500 cm H). Its negative pressure is −30 mmW.G. It is a place fore glove box removal operation. For the five air-lock rooms, there are a "personnel entry-exit room 1" briefly named A1 (dimensions: 154 L×156 W×250 cm H) with negative pressure −10 mmW.G., a "personnel entry-exit room 2" briefly named A2 (dimensions: 192×156×250 cm H) with negative pressure −8 mm W.G, and a "personnel entry-exit room 3" briefly named A3 (dimensions: 154×156×250 cm H) with negative pressure −6 mmW.G., which are the places provided for personnel contamination measurement and changing protective clothing and gloves and also as a buffer zone to prevent α contamination in removal operation zone from diffusing to G32 room and allow radioactive personnel to safely leave the quarantine tent. There are also a "large object transfer room 1" briefly named B1 (dimensions: 250×223×300 cm H) with negative pressure −14 mm W.G, "large object transfer room 2" briefly named B2 (dimensions: 250×223×300 cm H) with negative pressure −10 mm W.G, which is the place for packing with PVC bags the removed large wastes contaminated by transuranium compounds from the glove box (sedimentation tank, glove box panel, steel sheet etc.) and conducting contamination measurement and allows the large-scale wastes contaminated by transuranium compounds to be safely moved out of the quarantine tent without leak of a contamination. The system functions for the quarantine tent are in the following:

(1) Volume: length 915 cm×width 420 cm×height 500 cm; it meets the design requirements for operation space.

(2) Frame support and panel materials, such as load capacity, transparent and fire-resistance etc., are specially planned and designed; the panel transparency allows commanders outside the tent to keep up with the status of radioactive workers inside the tent and timely provide support during an incident in the removal process.

(3) The inner panel of the quarantine tent is designed with smoothness and flatness. After completion of each batch-wise operation, panel surface cleaning and detection are conducted (the panel can be covered by PVC cloth, which will be replaced after completion of each batch-wise operation), to lower airborne concentration.

(4) It is designed to have three "personnel entry-exit" rooms, which allow the workers to measure contamination and change clothes. The three rooms maintain stable airflow, sufficient air exchange to meet negative pressure requirement and effectively prevent leak of α contamination.

(5) It is designed to have two "large object removal" rooms for removal of large objects, such as sedimentation tank, glove box panel, steel sheet etc., after the glove box is removed. The two rooms maintain stable airflow, sufficient air exchange to meet negative pressure requirement and effectively prevent leak of α contamination.

(6) Quarantine tent "Removal Operation Section" has wastes exit for general wastes contaminated by transuranium compounds, such as protective clothing, PVC cloth, protective mat and small waste objects, and sample exit.

(7) The space is provided for removal tools, gas source, power source, hoist, lighting, speakers, camera and transport of transuranium wastes.

(8) It meets the design requirements for fittings and platforms for the air duct for the negative pressure ventilation system, butterfly valve, frame, HEPA filter and grids.

Since the removal of large-scale transuranium glove box adopts "In-Site Cutting Technique", it is necessary to build an alpha airtight quarantine tent around the glove box to maintain stable airflow and sufficient air exchange to meet negative pressure requirements and effectively prevent leak of α contamination. A negative pressure ventilation system is installed to work with the quarantine tent. The negative pressure ventilation system includes blower, exhaust fan, HEPA filter, various butterfly valve/air damper and air duct to assure the negative pressure gradient in the tent −6 mmW.G.→−8 mmW.G.→−10 mmW.G.→−10 mmW.G.→−15 mmW.G.→−30 mmW.G. and enable the gas flow from low contamination area to high contamination area. This can effectively prevent spreading of a contamination and increase safety for the transuranium disposal equipment that is not in service. The design for the airtight quarantine tent and ventilation system is to meet the requirements in Table 1 for large-scale transuranium equipment removal process and radiation prevention and safety.

TABLE 1

Requirements for Negative Pressure and Ventilation Conditions in the Quarantine Tent

| Section | A3 | A2 | A1 | B2 | B1 | C1 |
|---|---|---|---|---|---|---|
| Airflow rate CFM (NOR.) | 140 | 170 | 140 | 300 | 300 | 1050 |
| Air exchange rate (times/hour) | 39 | 38 | 39 | 30 | 30 | 21 |
| Airflow rate CFM (MAX.) | 225 | 250 | 225 | 400 | 400 | 1500 |
| Air exchange rate (times/hour) | 60 | 56 | 60 | 40 | 40 | 30 |
| Negative pressure mm W.G | −6 (±2) | −8 (±2) | −10 (±2) | −10 (±2) | −15 (±2) | −30 (±2) |

The operation for the negative pressure ventilation system to stabilize the negative pressure for each section in the quarantine tent:

1. During operation (1) A backup exhaust fan and a backup blower are provided for automatic takeover when the main units stop during "automatic" operation mode.

(2) During "automatic" operation mode, the exhaust fan will start first, and then the blower starts, which will help build up negative pressure. There are indication signal lights on the control panel for "operation" and "stop". "Red" light means the butterfly valve is fully opened during blower/exhaust fan operation, while "green" light means butterfly valve is fully closed during blower/exhaust fan operation.

(3) The negative pressure butterfly type control valves for the exhaust fan and the blower are located before the exhaust fan HEPA filter and after blower HEPA filter, and at the inlets and return air inlet for each air-lock room. So when the system starts, the related solenoid valve is energized to open the control valve. The control valve is failure type, which shuts off automatically when the power is out and therefore can prevent flow back of α contamination air from "removal operation section" and spreading into every air duck and G32 room.

2. During Idle (1) The blower stops first. At the same time, 10" blower butterfly valve shuts off. Then, the exhauster fan and the 10" exhaust fan butterfly valve shut off. After the butterfly valves for the blower and the exhaust fan shut off, 8" butterfly valve for each air-lock room will shut off.

(2) When blowers A, B or exhaust fans are running serially, others are backup units to satisfy the operation principle.

(3) When the power is out, each butterfly valve needs to shut off (spring driven), and blower/exhaust fan stop running. When the power resumes, restart A series of B series blower/exhaust fan and open all butterfly valves at the same time.

(4) When the equipment is set in "AUTO" mode, it can operate continuously. When it is set in "MANU" mode, it can independently control the operation of any butterfly valve or blower/exhaust fan.

(5) When the exhaust fan of the high negative pressure system for A49 room is back to operation, the system can start to operate.

(6) When system abnormality arises, there is an alarm system to prompt on-shift personnel to take emergency measures.

BRIEF DESCRIPTION OF THE DRAWING

FIGURE is three-dimensional diagram for the removed quarantine tent, negative pressure ventilation system for the transuranium glove box of the present invention for Unit 21.

DETAILED DESCRIPTION OF THE PREFERRED EMBODIMENT

FIGURE is the diagram for the quarantine tent and the negative pressure ventilation system removed from the transuranium glove box of Unit 21. As shown in the FIGURE, the operation range for the quarantine tent includes: removal operation section 10 (C1), personnel entry/exit room 19 (A1), personnel entry/exit room 28 (A2), personnel entry/exit room 36 (A3), large object transfer room 15 (B1), large object transfer room 24 (B2). There are six sections in total, which are one removal operation section 10 and five air-lock rooms.

The quarantine tent includes a removal operation section 10 (C1) and five airlock rooms (A1, A2, A3, B1 and B2). To maintain a gradient for the air flow in the quarantine tent from low negative pressure to high negative pressure and effectively control a particle direction in airflow, it is necessary to build a negative pressure ventilation system to work with the quarantine tent. The work scope for the negative pressure ventilation system includes four systems. The first is blower/exhaust fan 15 system, comprising main blower/exhaust fan units, front filter, absolute filter, 10" butterfly valve and air damper, two sets in total, one for normal operation and the other for backup (blower unit 1 in G32 room/exhaust fan unit 15 in A44 room. The second system is ventilation line, containing a blower 1 connecting to an air duct with manual air damper. After a plenum chamber there are five lines entering five air-lock rooms. That means there are an independent blower air duct 2 and a return air duct. There is an 8" butterfly valve and a manual balance air damper at inlet/return air ducts for each air-lock room. The negative pressure return air for the last five air-lock rooms meets in the front plenum chamber 7 of the removal operation section 10 and then goes into the removal operation section 10. After the back plenum chamber 13 of the removal operation section 10, the airflow enters the exhaust fan system 15. Both the front plenum chamber and the back plenum chamber have HEPA filter inside. The third system is equipment control, which comprises main switch for blower/exhaust fan, butterfly valve switch, alarm system and two sets of blower/exhaust fan that have automatic switch operation wired to system control panel with manual and automatic switches.

The fourth system is negative pressure monitor, which comprises detection points in eight places, C1, A1, A2, A3, B1, B2, G32 and G13. The six sections of the quarantine tent are connected to the negative pressure indicator outside the tent and display the negative pressure value. The eight detection points are monitored, measured and recorded by computer program and displayed with values on a large screen in G13 walkway.

The radiation safety and prevention process for radioactive workers entering/exiting the quarantine tent is as follows:

1. Operation procedures for radioactive workers entering the removal operation section 10 of the quarantine tent:

(1) First protective layer of protective underwear clothing includes: white cotton long sleeve clothes, pants, socks and working shoes (taking off personal clothes before dressing working clothes).

(2) Second protective layer of inner clothing includes: white full-body protective clothes including cap and shoe covers in addition to white cotton gloves.

(3) Third protective layer of clothing includes white full-body protective clothes including cap and shoe covers, in addition to surgical gloves.

(4) Protective mask.

(5) Fourth protective layer of full-body air-fed protective clothing includes cap, show covers and gloves, in addition to cotton working gloves and anti-slip working shoes.

(6) When entering removal operation section 10 of the quarantine tent, air supply tubing is connected to the protective clothing before starting removal task.

2. Operation procedures for radioactive workers exiting the removal operation section 10 of the quarantine tent:

(1) Taking off the fourth layer of full-body air-fed protective clothing includes taking off cotton working gloves in the removal operation section 10, disconnecting air supply tubing, taking off anti-slip shoes, and taking off the fourth layer of full-body air-fed protective clothes.

(2) Taking off the third layer of protective clothing includes taking off surgical gloves in personnel entry/exit room 9 and taking off the third layer of inner protective clothes.

(3) The first-run α contamination preventive inspection includes all the personnel entering/exiting room 28 subject to full-body inspection by portable α contamination detector by radiation prevention personnel, which also applies to full-body clothing and protective mask.

(4) Taking off the second layer of protective clothing includes taking off cotton white gloves when exiting G32 room of the quarantine tent and taking off the second layer of inner protective clothes.

(5) The second-run α contamination preventive inspection includes taking off protective mask at G30 room and subject to contamination wiping test by radiation prevention personnel and α detector inspection for shoe bottom α contamination.

(6) The second-run α contamination preventive includes subject to nose hole α contamination wiping test and recording by radiation prevention personnel at G35 room and hand and foot α detection by α/β detector in G13 walkway.

(7) Taking off the first layer of protective underwear clothing includes taking off white cotton long sleeve clothes, pants, cotton socks and working shoes, and taking shower to rinse full body and dress personal clothing.

What is claimed is:

1. A removal operation process for a large glove box contaminated by transuranium compounds comprising the following steps:

(a) dismantling the transuranium compounds contaminated glove box in removal operation section of a quarantine tent;

packing a dismantled part of the transuranium compounds contaminated large-scale wastes with a transuranium shielding bag as first-layer package, and moving the package to large object transfer room, and repeating the packing and moving to next transfer room in the foregoing steps at least two times for reducing transuranium contamination through negative pressure ventilation, and finally the package is subject to radiation detection, and moving the package from the quarantine tent into a container when there is no contamination detected;

(b) the airtight quarantine tent enclosing the glove box is running with negative pressure ventilation system, allowing the airflow to follow pressure gradient from low negative side to high negative side in the quarantine tent and enabling effective control of airborne α particle flow;

(c) after the negative pressure ventilation system starts running, solenoid valve is energized to open a failure type control valve, which shuts off automatically when the power is out and therefore prevent flow back of α contamination air from the removal operation section and spreading into air duct and rooms; and in a shutting off process, a blower of the negative pressure ventilation system stops first, and a blower butterfly valve shuts off at the same time, and then an exhaust fan and its butterfly valve shut off, wherein after the blower and its butterfly valve both shut off, butterfly valve for each air-lock room in the quarantine room shuts off to prevent ventilation line contamination.

2. According to the removal operation process for a large glove box contaminated by transuranium compounds in claim 1, the negative pressure ventilation system working scope comprising four systems: the first is blower and exhaust fan system, the second is ventilation line system, the third is equipment control system and the fourth is negative pressure monitor system.

3. According to the working scope for the negative pressure ventilation system in claim 2, the blower and exhaust fan system comprising blower and exhaust fan, front filter, absolute filter, butterfly valve and air damper.

4. According to the working scope for the negative pressure ventilation system in claim 2, the ventilation line system comprising a blower that connects to an air duct with manual air damper, and after a plenum chamber, five ventilation lines entering five air-lock rooms having an independent blower air duct and a return air duct, and a butterfly valve and manual balance air dampers at inlet/return air duct for each air-lock room, wherein the negative pressure return air for the last five air-lock rooms meets in the front plenum chamber of the removal operation section and then goes into the removal operation section, wherein after the back plenum chamber of the removal operation section, the airflow enters the exhaust fan system, wherein both the front plenum chamber and the back plenum chamber are furnished with filters inside.

5. According to the working scope for the negative pressure ventilation system in claim 2, the equipment control system comprising main blower and exhaust fan switches, butterfly valve switch, alarm system, and two sets of blower and exhaust fan having automatic switch operation wired to system control panel with manual and automatic switches.

6. According to the working scope for the negative pressure ventilation system in claim 2, the negative pressure monitor system comprising negative pressure detection points, wherein the quarantine tent is equipped with negative pressure indicator, wherein the negative pressure detection points are monitored, measured and recorded by computer program and displayed with values on a large screen.

7. A removal equipment for a large-scale glove box contaminated by transuranium compounds comprising:

a quarantine tent enclosing the glove box to prevent spreading of plutonium $\alpha$ contamination including one removal operation section and five air-lock rooms; wherein a negative pressure ventilation system is provided in the quarantine tent to operate with the quarantine tent comprising:

a blower fan system having a plenum connecting with air ducts, comprising blower fan, front filter, absolute filter, butterfly valve and air damper, a plenum chamber connecting with the air duct from the blower and diverging in five ventilation lines for entering into the five air-lock rooms, wherein each of the five lines entering the five air-lock rooms are provided with an independent blower air duct and a return air duct, wherein butterfly valves and manual balance air dampers are provided at inlet and return air ducts for each air-lock room, the negative pressure return air from the five air-lock rooms converging in a front plenum chamber of the removal operation section and then flowing into the removal operation section, and an exhaust fan system having the front plenum and a back plenum connecting with air ducts, comprising blower fan, front filter, absolute filter, butterfly valve and air damper provided for return air from the back plenum chamber of the removal operation section, wherein both the front plenum chamber and the back plenum chamber are furnished with filters inside.

8. According to the removal equipment for a large-scale glove box contaminated by transuranium compounds in claim 7 further comprising an equipment control apparatus including main blower and exhaust fan switches, butterfly valve switch, alarm device, and two sets of blower and exhaust fan having automatic switch operation wired to system control panel with manual and automatic switches.

9. According to the removal equipment for a large-scale glove box contaminated by transuranium compounds in claim 7 further comprising negative pressure detection points, wherein the quarantine tent is equipped with negative pressure indicator, wherein the negative pressure detection points are monitored, measured and recorded by computer program and displayed with values on a large screen.

* * * * *